United States Patent [19]

Moore

[11] 4,013,941

[45] Mar. 22, 1977

[54] TRANSFORMER VOLTAGE REGULATOR RESPONSIVE TO INPUT VARIATIONS

[76] Inventor: Charles R. Moore, 1615 Merrifield, Mishawaka, Ind. 46544

[22] Filed: Mar. 26, 1976

[21] Appl. No.: 670,981

[52] U.S. Cl. ..... 323/45; 323/62

[51] Int. Cl.[2] ..... G05F 5/00; G05F 1/24

[58] Field of Search ..... 323/6, 44 R, 45, 57, 323/58, 60, 61, 62

[56] References Cited

UNITED STATES PATENTS

| | | | |
|---|---|---|---|
| 1,654,948 | 1/1928 | Thompson | 323/45 |
| 2,755,429 | 7/1956 | Scherer | 323/66 |
| 2,994,030 | 7/1961 | Diebold | 323/45 |
| 3,018,431 | 1/1962 | Goldstein | 323/45 |
| 3,075,138 | 1/1963 | Croft et al. | 323/45 |
| 3,350,631 | 10/1967 | Ingman | 323/45 |
| 3,379,860 | 4/1968 | May | 323/45 |
| 3,419,788 | 12/1968 | May | 323/6 |
| 3,611,117 | 10/1971 | Schneider | 323/62 |
| 3,732,486 | 5/1973 | Schoendube | 323/62 |

FOREIGN PATENTS OR APPLICATIONS

| | | | |
|---|---|---|---|
| 1,811 | 9/1967 | Japan | 323/45 |

*Primary Examiner*—Gerald Goldberg

*Attorney, Agent, or Firm*—Woodhams, Blanchard and Flynn

[57] ABSTRACT

A voltage regulator apparatus for controlling a voltage at the output side of a line in accordance with variations of the voltage at the input side of the line. The voltage regulator includes a transformer having a primary winding and a secondary winding, the secondary winding being inserted in the line. Control circuitry is provided for controlling the switching of the primary winding to the input side of the line, which control circuitry includes a series connected saturable inductor having a predefined saturation level and a rectifier connected to the input side of the line. Sensing circuitry is provided which is responsive to a predefined voltage at the output of the rectifier occurring when the inductor is in the saturated condition, the sensing circuitry being nonresponsive to the voltage at the output terminal of the rectifier when the inductor is in an unsaturated state. A responsiveness of the sensing circuitry to the output voltage of the rectifier effects an altering of the control circuitry to either connect the primary winding to the input side of the line or a shorting out of the primary winding.

8 Claims, 5 Drawing Figures

TRANSFORMER VOLTAGE REGULATOR RESPONSIVE TO INPUT VARIATIONS

FIELD OF THE INVENTION

This invention relates to a voltage regulator apparatus and, more particularly, a voltage regulator apparatus for controlling a voltage at the output side of a line in accordance with variations of the voltage at the input side of the line.

BACKGROUND OF THE INVENTION

Voltage controllers, voltage feed-back control apparatus, and automatic voltage control and compensating networks cover a wide field in the art. Voltage control has been attained with a large variety of components includng electronic switching and amplifying elements, magnetic amplifiers, servo controlled variable transformers and rheostats. The basic object of any voltage regulator is to provide a system of protecting equipment, such as air conditioners, motors and the like, which would otherwise be damaged due to overly large voltage variations and/or fluctuations. Much of the equipment which is to be protected draws a considerable amount of power and the voltage regulating device is usually very expensive. It is desirable to have a voltage regulator apparatus which will provide the necessary protection for electrical equipment but without incorporating therein expensive components and the resulting large physical size and/or large weights.

Accordingly, it is an object of this invention to provide a voltage regulator apparatus for controlling the voltage at the output side of a line in accordance with variations of the voltage at the input side of the line.

It is a further object of this invention to provide a voltage regulator apparatus, as aforesaid, utilizing inexpensive components and a corresponding structure which is light in weight and occupies a minimum of physical space inside the standard housing structure therefor.

It is a further object of this invention to provide a voltage regulator apparatus, as aforesaid, utilizing a saturable inductor as a control for detecting variations in the voltage at the input side of the voltage regulator which fall above or below a predetermined voltage level and to use the saturated state of the saturable inductor as a device for initiating a control of the output voltage from the voltage regulator.

SUMMARY OF THE INVENTION

In general, the objects and purposes of the invention are met by providing a transformer having a primary and secondary winding, the secondary winding being inserted in the line which is to be controlled. A switch is provided between the input side of the line and one of the input terminals to the primary winding and between the pair of input terminals to the primary winding. A series connected saturable inductor and a rectifier are connected to the input side of the line. The saturable inductor has a predefined saturation level at which the inductor becomes saturated. A sensing circuit is responsible to a predefined output voltage at the rectifier occurring when the inductor is in the saturated state. The sensing circuitry is nonresponsive to the voltage at the output terminal of the rectifier when the inductor is in the unsaturated state. A responsiveness of the sensing circuitry to the output voltage of the rectifier effects an altering of the state of the switch to effect either a connecting of the primary winding to the input side of the line or a shorting out of the primary winding.

BRIEF DESCRIPTION OF THE DRAWINGS

Further objects and purposes of this invention will be apparent to persons acquainted with apparatus of this general type upon reading the following specification and inspecting the accompanying drawings, in which.

DETAILED DESCRIPTION

Figure 1:
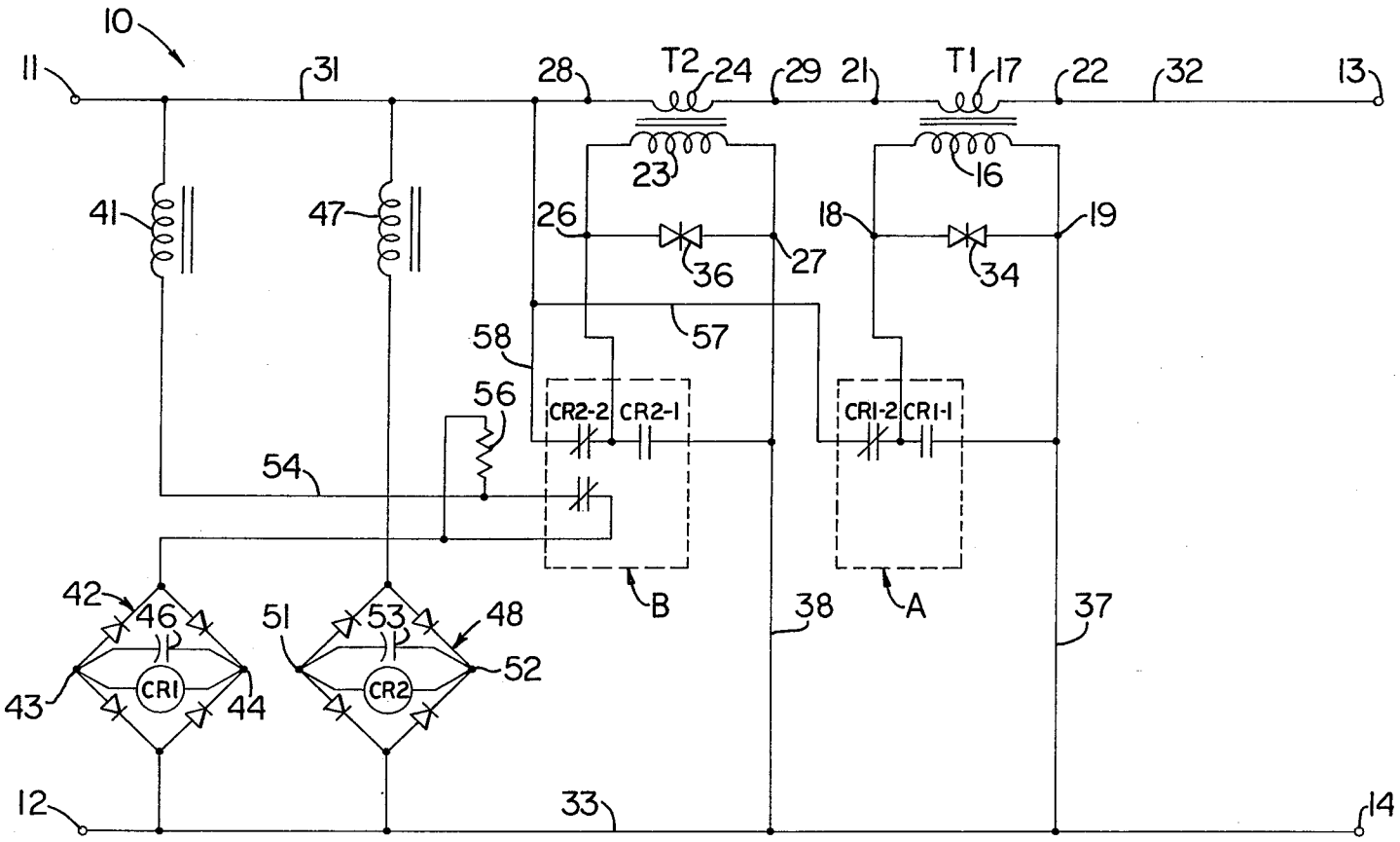
FIG. 1 is an electrical schematic diagram illustrating a first embodiment of my invention.

A voltage regulator apparatus 10 embodying my invention is illustrated in FIG. 1. The voltage regulator apparatus 10 is connected at its input terminals 11 and 12 to a source of electrical power, here a conventional source of AC power, such as would be available from the transmission lines supplying power to an industrial complex, residential complex or the like. The voltage regulator apparatus 10 also has a pair of output terminals 13 and 14 which are connected to a consumer of electrical power, such as an air conditioner, motor or the like.

A pair of transformers T1 and T2 are incorporated in my voltage regulator apparatus 10. The transformer T1 has a primary winding 16 and a secondary winding 17. The primary winding 16 has a pair of input terminals 18 and 19 and the secondary winding has a pair of terminals 21 and 22. Similarly, the transformer T2 has a primary winding 23 and a secondary winding 24. The primary winding 23 has a pair of input terminals 26 and 27 and the secondary winding 24 has a pair of terminals 28 and 29. In this particular embodiment, the secondary windings 17 and 24 are series connected between the terminals 11 and 13. A line 31 connects the input terminal 11 to the terminal 28 on the primary winding 24 and a line 32 connects the terminal 22 on the secondary winding 17 to the output terminal 13. The terminals 21 and 29 of the secondary windings are interconnected. A common line 33 interconnects the input terminal 12 to the output terminal 14. The terminals 19 and 27 of the transformers T1 and T2 are connected through lines 37 and 38, respectively, to the common line 33. In addition, a conventional thyrector 34 is connected between the input terminals 18 and 19 on the primary winding 16. Similarly, a thyrector 36 is connected between the input terminals 26 and 27 of the primary winding 23. The thyrectors 34 and 36 are used primarily to protect other components in the circuitry from high voltage reverse transients, which are usually short-lived voltages, which occur when power is applied or removed to the transformers T1 and T2. The thyrectors 34 and 36 have a relatively high power recitation capability under transient conditions and are ideal for surge voltage suppression. Since thyrectors are well known electrical components, further discussion as to their characteristics are believed well known to those skilled in the art.

Figure 1A:
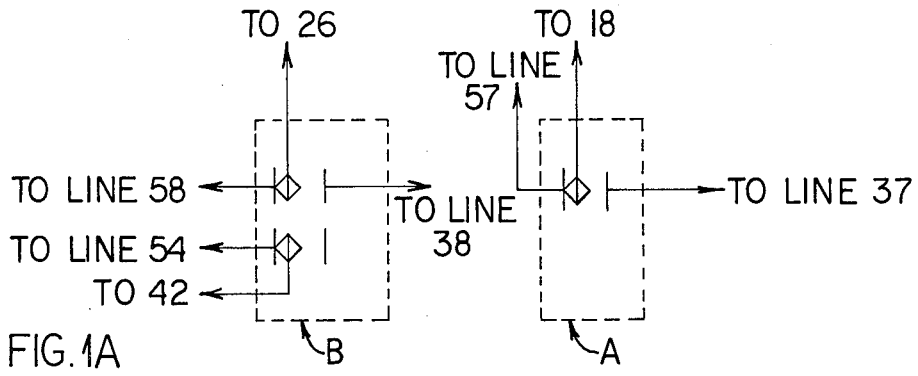
FIG. 1A is an electrical schematic of an equivalent switch arrangement in the circuit of FIG. 1.

The control circuitry for the voltage regulator apparatus 10 is composed of a saturable inductor 41 connected on one side to the line 31 and on the other side to a four-diode bridge full-wave rectifier circuit 42. The saturable inductor 41 and the full-wave rectifier circuit 42 are series connected between the lines 31 and 33. The output terminals 43 and 44 of the full-wave rectifier circuit 42 have a parallel connected conventional control relay CR1 and capacitor 46 connected therebetween. The control relay CR1 has electrical contacts schematically illustrated at CR1-1 and CR1-2. The electrical contacts CR1-1 and CR1-2 in the broken line box marked "A" could also be shown by an equivalent switching arrangement, namely a single pole, double throw type switch designation having no center off position as illustrated in FIG. 1A. The location of the electrical contacts CR1-1 and Cr1-2 will be described in detail below. The control relay CR1 is of a conventional variety having a coil which when energized changes the state of the electrical contacts CR1-1 and CR1-2.

Similarly, the control circuitry also includes another saturable inductor 47 and another four-diode bridge full-wave rectifier circuit 48. The saturable inductor 47 and the full-wave rectifier circuit 48 are series connected between the lines 31 an 33, namely parallel to the series connected saturable inductor 41 and full-wave rectifier circuit 42. The output terminals 51 and 52 of the full-wave rectifier circuit 48 have a parallel connected conventional control relay CR2 and capacitor 53 connected therebetween. The control relay CR2 has a plurality of schematically illustrated electrical contacts, namely electrical contacts CR2-1, CR2-2 and CR2-3. The electrical contacts CR2-1, CR2-2 and CR2-3 in the broken line box marked "B" could also be shown by an equivalent switching arrangement, namely a double pole, double throw switch designation having no center off position as illustrated in FIG. 2A. The location of the electrical contacts CR2-1, CR2-2 and CR2-3 will be described in detail below. The capacitors 46 and 53 serve to average the current from the output of the rectifiers 42 and 48 to a useful value to effect a continuous energizing of the control relays at the appropriate time.

A line 54 extending between the saturable inductor 41 and the full-wave rectifier circuit 42 has the electrical contact CR2-3 connected therein, which electrical contact is a normally closed contact and becomes opened upon an energization of a coil embodied in the control relay circuitry CR2. A resistor 56 is connected in parallel with the electrical contact CR2-3.

The electrical contact CR1-1 is a normally open contact and is connected between the input terminals 18 and 19 to the primary winding 16 of the transformer T1. The electrical contact CR1-2 is a normally closed contact which is connected on one side thereof through a line 57 to the line 31 and on the other side to the input terminal 18 to the primary winding 16 of the transformer T1. The electrical contact CR2-1 is a normally open electrical contact which is connected between the input terminals 26 ad 27 of the primary winding 23 of the transformer T2. The electrical contact CR2-2 is a normally closed contact which is connected on one side thereof through a line 58 to the line 31 and on the other side to the input terminal 26 of the primary winding 23.

As with some voltage regulator apparatus, in order to control the voltage, it is necessary to have a device for measuring the input voltage, making a decision according to that measurement and then acting upon that decision. The saturable inductors 41 and 47 are instrumental in measuring the voltage input to my voltage regulator apparatus 10. The saturable inductor 41, for example, is designed to offer a high AC impedance to any applied voltage up to a certain designed voltage value. Above this value, part of each AC cycle becomes so great as to cause what is often referred to as "saturation" of the inductor. That is, during the portion of each cycle that saturation occurs, large nonlinear current spikes readily flow through the inductor because the inductor can no longer generate magnetic flux changes after it reaches the full saturation state. At voltages below the critical design voltage, the saturable inductor 41 offers very high impedance to the current flow. Therefore, at or near the critical voltage design point, the impedance, and consequently the current flow, can change rapidly. As just a few volts below the critical point, the impedance is still large and consequently the current flow low. At just a few volts above the critical point, the impedance becomes low during part of each cycle and the current becomes very much larger. Typically, and in one embodiment, the saturable inductor 41 will reach a critical point at about 105 volts AC applied across the input terminals 11 and 12 of the voltage regulator apparatus. It is to be recognized, however, that the saturable inductor 41 could be designed for any critical value for use in other systems in utilizing 220 volts AC, 440 volts AC and the like. In this particular embodiment, and for purposes of this discussion, it will be assumed that the input voltage ranges between 90 and 130 volts AC and the desired voltage range which is to be maintained at the output terminals 13 and 14 of the voltage regulator apparatus is in the envelope of 110 and 130 volts AC. Similarly, and in one embodiment, the saturable inductor 47 is designed to offer high impedance below 115 volts AC and low impedance above 115 volts AC. It is to be recognized that other input voltage ranges may exist and the range specified herein is not to be limiting.

The transformers T1 and T2 are each wound in a manner to have a 10 : 1 ratio. It is to be recognized, however, that if more than two transformers T1 and T2 are utilized, the winding ratios of the transformers can be varied to accomodate the desired result.

OPERATION

Although the operation of the voltage regulator apparatus embodying my invention has been indicated somewhat above, the operation will be described in detail below for convenience.

For purposes of discussion, and as indicated above, the desired voltage range which is to maintained as close as possible across the output terminals 13 and 14 of the voltage regulator apparatus is in the envelope of 110 130 volts AC. For purposes of discussion, it will be assumed that a low line voltage of 100 volts AC is applied at the input terminals 11 and 12. At 100 volts AC, the saturable inductor 41 does not allow sufficient current to flow to the full-wave rectifier 42 to permit the control relay CR1 to be activated. Similarly, the saturable inductor 47 also does not permit a sufficient current to flow to the full-wave rectifier 48 to activate the control relay CR2. As a result, the electrical contacts CR1-1 and CR1-2, as well as the electrical contacts CR2-1, CR2-2 and CR2-3 are in the normal condition illustrated in FIG. 1. Thus, electrical current will flow to each of the primary windings 16 and 17 of the transformers T1 and T2 to effect an energization of the secondary windings 17 and 24. The polarity of the transformers T1 and T2 are identical so that the voltage produced at the secondary windings 17 and 24 are additive to the voltage applied at the input terminal 11. Since the transformers T1 and T2 have a 10 : 1 turns ratio and the line voltage is, as has been assumed above 100 volts AC, then each transformer T1 and T2 produces a total of 10 volts so that the total output voltage across the output terminals 13 and 14 is 100 + 10 + 10 or 120 volts AC. As the line voltage increases gradually from 100 volts AC to 110 volts AC, the following events will occur. Upon the line voltage applied at the input terminals 11 and 12 reaching 105 volts AC, the saturable inductor 41 will become saturated due to the fact that it was designed to become saturated at 105 volts AC as assumed above. At slightly above 105 volts AC, the current flow through the saturable inductor 41 will increase dramatically (see FIG. 3) and will suddenly be sufficient to energize the control relay CR1. An energization of the control relay CR1 will change the state of the electrical contacts CR1-1 from the normally open position to a closed condition and the normally closed condition of the contact CR1-2 to an open condition. As a result of the closing of the contacts CR1-1, the primary winding 16 of the transformer T1 will be shorted out. Thus, the secondary winding 17 will contribute no voltage and the total voltage output at the output terminals 13 and 14 will be the magnitude of the input voltage 110 volts AC plus approximately 11 volts from the secondary winding 24 of the transformer T2 so that the total voltage output at the output terminals 13 and 14 will be 121 volts AC. As long as the voltage at the input terminals 11 and 12 remains below the critical value of 115 volts for the saturable inductor 47, the transformer T2 will remain energized. Once the input voltage across the input terminals 11 and 12 of the voltage regulator apparatus 10 increases to a level above 115 volts, the saturable inductor 47 will enter the saturable state and a sufficient current will then flow to energize the control relay CR2 and change the state of each of the electrical contacts CR2-1, CR2-2 and CR2-3. More particularly, the normal open contact CR2-1 will become closed to effect a shorting out of the primary winding 23 of the transformer T2 and the normally closed contacts CR2-2 and CR2-3 will become open. The control relay CR1 will remain energized through the resistor connection 56 in the line 54 after the electrical contact CR2-3 becomes opened. The resistor 56 also serves the purpose of preventing too much current from flowing through the saturable inductor 41 to damage same. If desired, the same protective feature can be incorporated in the circuit having the saturable inductor 47 therein.

If the line voltage at the input terminals 11 and 12 begins to drop, a reverse of the foregoing procedure will occur. That is, the saturable inductor 47 will first become unsaturated to effect an energization of the primary winding 23 of the transformer T2 and subsequently, and assuming the voltage continues to fall below the critical value for the saturable inductor 41, the saturable inductor 41 will become unsaturated to effect a deenergization of the control relay CR1 and the resulting energization of the primary winding 16 of the transformer T1.

Figure 3:
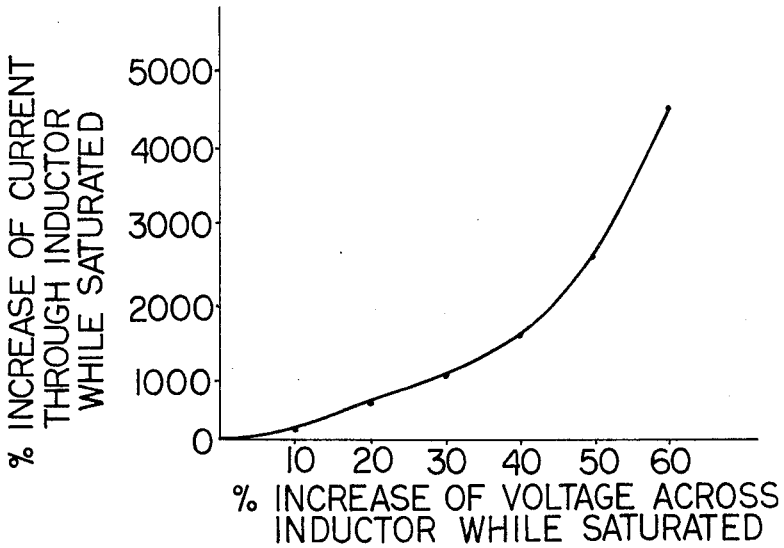
FIG. 3 is a graph illustrating the magnitude of the current through a saturable inductor of the type embodied in my invention based upon an increase in voltage above a predefined voltage level at which the inductor is in the saturable state.

It is to be noted that from a review of the diagram illustrated in FIG. 3 that the increase in current flow through the saturable inductor increases quite dramatically once the inductor enters the saturable state. For example, a 30% increase in voltage above the critical value for a particular inductor results in an increase in current of approximately 1000%. Even a 10% increase in voltage results in a substantial current increase of approximately 100%.

It is also to be recognized that I can use more transformers than just the two transformers T1 and T2 described above in order to more accurately regulate the voltage at the output terminals 13 and 14. This would require one additional series connected saturable inductor and full-wave rectifier, including a parallel connected control relay and capacitor connected between the output terminals of the rectifier, for each added transformer, the saturation level for the added inductor, of course, being appropriately selected relative to the saturation levels of the inductors 41 and 47, for example.

ALTERNATE CONSTRUCTION

Figure 2:
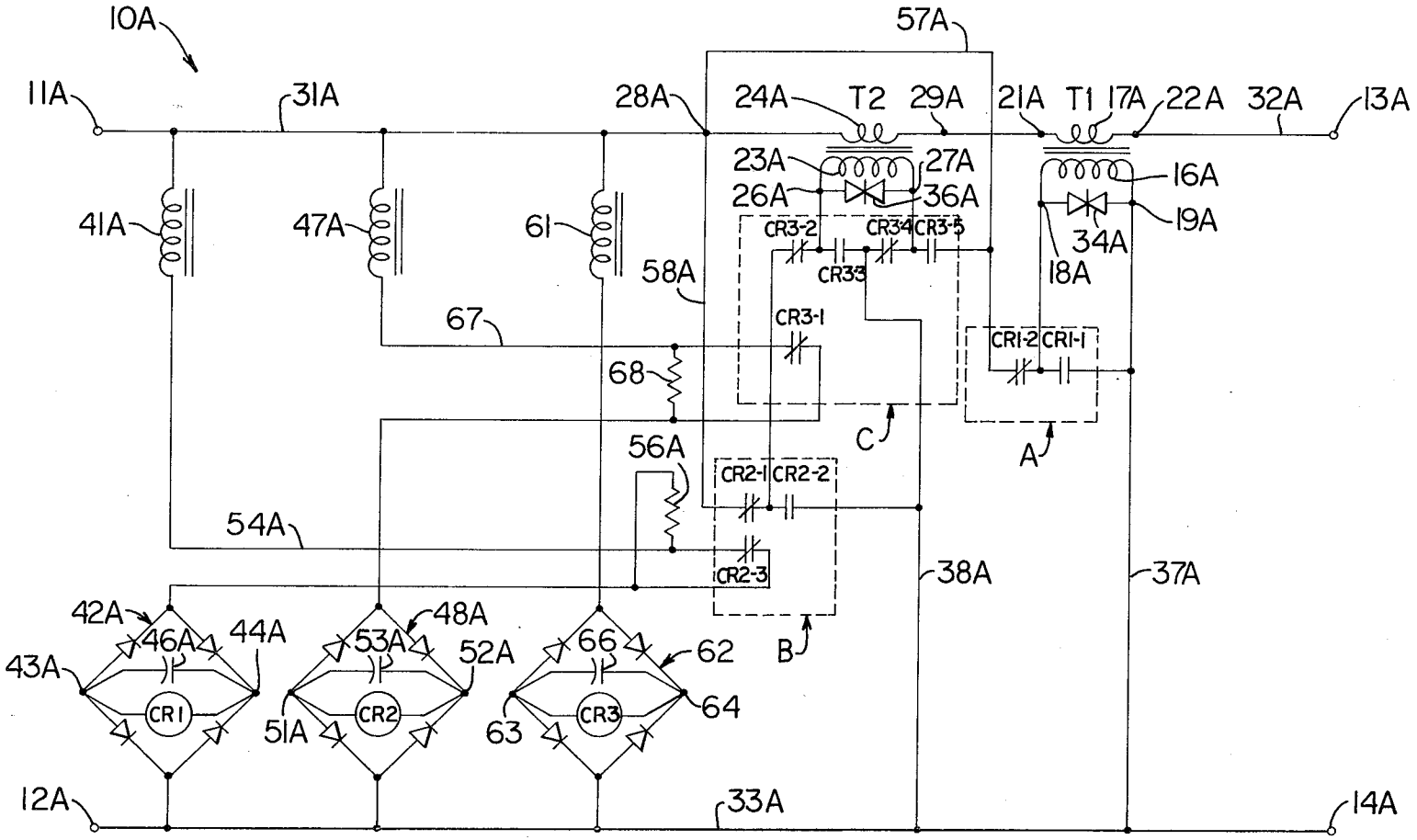
FIG. 2 is an electrical schematic diagram illustrating a second embodiment of my invention.
Figure 2A:
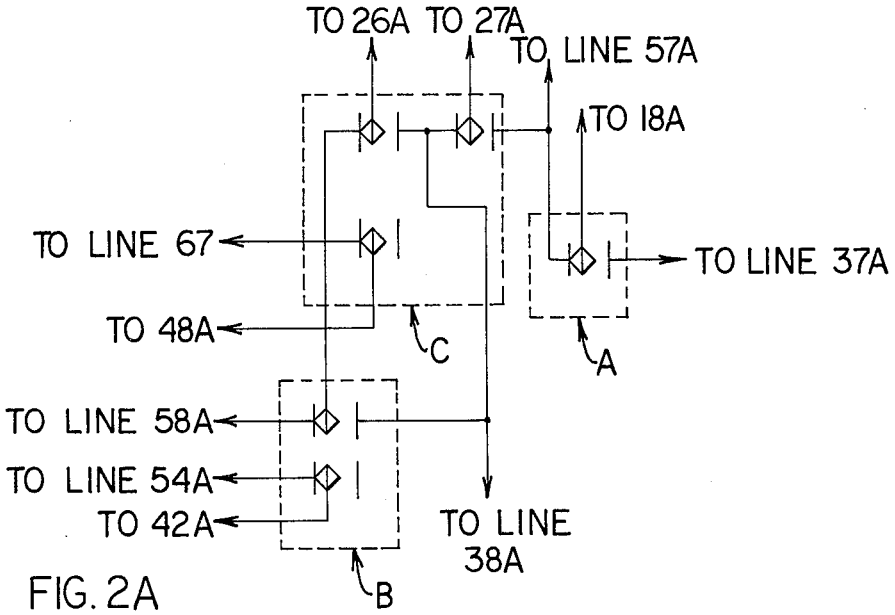
FIG. 2A is an electrical schematic of an equivalent switch arrangement in the circuit of FIG. 2.

A modified voltage regulator apparatus 10A is illustrated in FIG. 2. The components of the modified circuit 10A which are identical to the circuit illustrated in FIG. 1 will be described utilizing the same reference numerals but with the suffix "A" added thereto. Since the components in FIG. 2 incorporate much of the same connections as exist in the circuitry of FIG. 1, a discussion concerning the interconnections that are the same is believed unnecessary. Accordingly, the following discussion will pertain only to the differences between the circuitry of FIGS. 1 and the circuitry of FIG. 2.

The voltage regulator apparatus 10A has a third saturable inductor 61 series connected to a four-diode bridge full-wave rectifier circuit 62 connected between the line 31A and the line 33A. The output terminals 63 and 64 of the full-wave rectifier circuit 62 has a parallel connected control relay CR3 and capacitor 66 connected therebetween. The control relay CR3 has a plurality of schematically illustrated electrical contacts, here electrical contacts CR3-1, CR3-2, CR3-3, CR3-4 and CR3-5. The location of the electrical contacts will be described in detail below. The electrical contacts CR3-1, CE3-2, CR3-3, CR3-4 and CR3-5 in the broken line box "C" could also be shown by an equivalent switching arrangement, namely a triple pole, double throw switch designation having no center off position as illustrated in FIG. 2A.

The line 67 connecting the saturable inductor 47A to the full-wave rectifier circuit 48A has a normally closed contact CR3-1 connected therein. A resistor 68 is connected in parallel with the electrical contact CR3-1.

The input terminal 26A of the primary winding 23A of the transformer T2 is connected through a normally closed electrical contact CR3-2, a normally closed electrical contact CR2-1 and line 58A to the line 31A. The other input terminal 27A of the primary winding 23A is connected through a normally closed electrical contact CR3-4 to the line 38A to the line 33A. The input terminal 26A is also connected to one side of a normally open contact CR3-3, the other side thereof being connected to the line 38A. The input terminal 27A is connected to one side of a normally open electrical contact CR3-5, the other side thereof being connected to the line 57A.

The circuitry of the embodiment of FIG. 2 operates generally the same as was described above with respect to the operation of the circuit in FIG. 1. However, the circuitry of FIG. 2 has the additional feature that if the voltage at the input terminals 11A and 12A exceeds a voltage level of, for example, 130 volts AC, the saturable inductor 61 will become saturated so that high currents will flow to the rectifier 62 and effect an energization of the control relay CR3. An energization of the control relay CR3 will effect a change in the normal condition of each of the electrical contacts thereof, namely electrical contacts CR3-1, CR3-2, CR3-3, CR3-4 and CR3-5. Thus, current will flow through the line 37A to the line 57A and the now closed electrical contact CR3-5 to energize the input terminal 27A of the primary winding 23A of the transformer T2. The other side of the primary winding 23A, particularly the terminal 26A, is now connected through the now closed electrical contact CR3-3 to the line 38A. As a result, and at an input voltage of 130 volts AC, the transformer T2 is energized in reverse so that a subtractive voltage of 13 volts AC is created on the line to make the voltage across the output terminals 13,14 at 117 volts. It is to be recognized that at this point in time, the transformer T1 will be deenergized due to a shorting out of the primary winding 16A through the closed electrical contact CR1-1 resulting from the energization of the control relay CR1. In addition, the magnitude of current through the saturable inductor 47A is controlled by the resistor 68 which also maintains the energization of the control relay CR2.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A voltage regulator apparatus for controlling a voltage at the output side of a line in accordance with variations of the voltage at the input side of the line, comprising:

a transformer having primary and secondary windings, said secondary winding being inserted in said line, said primary winding having a pair of input terminals;

control means including a switching means between said input side of said line and one of said pair of input terminals to said primary winding and between said pair of input terminals of said primary winding for at least one of (1) connecting said primary winding to said input side of said line and (2) shorting out of said primary winding and a series connected saturable inductor having a predefined saturation level and rectifier means connected to said input side of said line, said rectifier having an input terminal and an output terminal; and sensing means responsive to a predefined voltage at said output terminals of said rectifier means occurring when said inductor is saturated, said sensing means being nonresponsive to said voltage at said output terminal when said inductor is in an unsaturated state, a responsiveness of said sensing means to said output voltage effecting an altering of the state of said switching means to at least one of connecting said primary winding to said input side of said line and shorting out said primary winding.

2. A voltage regulator apparatus according to claim 1, wherein said control means further includes a second transformer having a second primary winding and a second secondary winding, said second secondary winding being inserted in said line in series with said first mentioned secondary winding, said second primary winding having a pair of input terminals, second switching means between said input side of said line and one of said pair of input terminals to said second primary winding and between said pair of input terminals of said primary winding for at least one of (1) connecting said second primary winding to said input side of said line and (2) shorting out said second primary winding, a second series connected saturable second inductor having a second predefined saturation level different from said first predefined saturation level and second rectifier means connected in parallel to said first mentioned series connection; and wherein said sensing means is responsive to said second predefined voltage at the output terminal of said second rectifier means occurring when said second inductor is saturated, and sensing means being nonresponsive to the voltage output of said second rectifier means when said second inductor is in an unsaturated state, a responsiveness of said sensing means to said voltage output of said second rectifier means effecting an altering of the state of said second switching means to at least one of connecting said second primary winding to said input side of said line and shorting out said second primary winding.

3. A voltage regulator apparatus according to claim 2, wherein said control means includes protective resistance means connected in series with said saturable first inductor for preventing an over energizing of said saturable first inductor.

4. A voltage regulator apparatus according to claim 2, wherein said control means includes third switching means for connecting said pair of input terminals to said second primary winding to said input side of said line in reverse of said connection provided by said second switching means and a third series connected saturable inductor having a third predefined saturation level different from said first and second predefined saturation levels and third rectifier means connected in parallel to said first mentioned series connection; and wherein said sensing means is responsive to said third predefined voltage at the output terminal of said third rectifier means occurring when said third inductor is saturated, said sensing means being nonresponsive to the voltage output of said third rectifier means when said third inductor is in an unsaturated state, a responsiveness of said sensing means to said voltage output of said third rectifier means effecting an altering of the state of said third switching means and of said second primary winding relative to said input side of said line.

5. A voltage regulator apparatus according to claim 4, wherein said sensing means includes three relay coils of three switching relays, each relay coil being connected to one of said voltage outputs of said first mentioned, second and third rectifier means; and wherein said first mentioned switching means include electrical contacts on one of said switching relays, wherein said second switching means include electrical contacts on a second of said switching relays and wherein said third switching means include electrical contacts on a third of said switching relays.

6. A voltage regulator apparatus according to claim 1, wherein said first mentioned predefined voltage level is lower than said second predefined voltage level.

7. A voltage regulator apparatus according to claim 1, wherein said sensing means includes a relay coil of an electrical switching relay; and wherein said switching means are electrical contacts on said electrical switching relay.

8. A voltage regulator apparatus according to claim 7, wherein said sensing means further includes a capacitor connected in parallel to said relay coil for averaging the current from the output of said rectifier means.

* * * * *